United States Patent [19]

Verdouw

[11] 3,930,369

[45] Jan. 6, 1976

[54] LEAN PRECHAMBER OUTFLOW COMBUSTOR WITH TWO SETS OF PRIMARY AIR ENTRANCES

[75] Inventor: Albert J. Verdouw, Indianapolis, Ind.

[73] Assignee: General Motors Corporation, Detroit, Mich.

[22] Filed: Feb. 4, 1974

[21] Appl. No.: 439,646

[52] U.S. Cl. ..... 60/39.65; 60/39.71; 60/39.74 R

[51] Int. Cl.[2] ..... F02C 7/22; F02G 3/00

[58] Field of Search ..... 60/39.74 R, 39.65, 39.71, 60/39.06, 39.23; 431/173, 351, 352; 239/400, 403, 427.3, 427.5

[56] References Cited

UNITED STATES PATENTS

| | | | |
|---|---|---|---|
| 1,777,411 | 10/1930 | Mayr | 431/173 |
| 2,249,489 | 7/1941 | Noack | 60/39.65 |
| 2,756,040 | 7/1956 | Golden | 60/39.65 X |
| 3,067,582 | 12/1962 | Schirmer | 60/39.71 X |
| 3,119,234 | 1/1964 | Murray et al. | 60/39.65 X |
| 3,577,878 | 5/1971 | Greenwood et al. | 60/39.65 |
| 3,691,762 | 9/1972 | Ryberg et al. | 60/39.65 X |
| 3,703,259 | 11/1972 | Sturgess et al. | 60/39.74 B X |

OTHER PUBLICATIONS

*Combustion in Advanced Gas Turbine Systems*, Pergamon Press, Great Britain 1968, A. H. Lefebure, pp. 14–15.

N. A. Azelborn et al., "Low Emissions Combustion for the Regenerative Gas Turbine," Journal of Engineering for Power, Jan., 1974, pp. 49–51.

*Primary Examiner*—C. J. Husar
*Assistant Examiner*—Thomas I. Ross
*Attorney, Agent, or Firm*—Paul Fitzpatrick

[57] ABSTRACT

A combustion apparatus for gas turbine engines particularly adapted to reduce emissions to meet automotive requirements. The fuel is laid on the wall of a cylindrical prechamber and evaporated from the wall by combustion air which is introduced through a swirler at the upstream end of the prechamber. The inner surface of the prechamber is artificially roughened by a grid of grooves to improve fuel evaporation. The fuel is laid on the wall from an annular manifold extending around the upstream end of the prechamber through tangential orifices leading from the manifold into the interior of the prechamber. The fuel manifold is cooled and shielded from heat by an air jacket. More air enters through entrance ports distributed around the prechamber toward its downstream end. The resulting lean fuel-air mixture is delivered past an annular flow dam at the outlet of the prechamber into a combustion or reaction zone which is abruptly enlarged from the prechamber. The structure causes turbulent flow, recirculation, and good mixing in the reaction zone. A dilution zone downstream of the reaction zone has a circumferential array of dilution air ports which are of such shape as to be varied nonlinearly in area by a sliding ring valve. The sliding ring valve is coupled to a second sliding ring valve which varies the area of the air entrance ports in the prechamber in reverse sense to the dilution air ports. A pilot fuel nozzle to aid in cold starts is mounted at the upstream end of the prechamber.

2 Claims, 12 Drawing Figures

LEAN PRECHAMBER OUTFLOW COMBUSTOR WITH TWO SETS OF PRIMARY AIR ENTRANCES

This invention is directed to combustion chambers of a type suitable for use with gas turbine engines. It is particularly directed to combustion chamber structures adapted to insure complete combustion over relatively wide ranges of air and fuel flow and to minimize discharge of incompletely burned fuel and generation of oxides of nitrogen.

It is well known that the United States government has established standards for emissions of unburned hydrocarbons, carbon monoxide, and oxides of nitrogen for motor vehicles with a view to reducing atmospheric pollution. The standards established by legislation for 1977 are extremely stringent. Procedures established by the Government for determination of compliance with such standards by automotive vehicles are based upon a particular specified test cycle involving starting the engine, accelerations, decelerations, and operation at various speeds. This cycle is intended to simulate driving under urban traffic conditions.

The combustion chamber in which the present invention is embodied has been tested and found to be capable of meeting the 1977 emission standards in a suitable vehicle installation.

By way of background, successful gas turbine combustion chambers have been in existence for some decades. Originally, primary aims in development of such combustors were to achieve reliable operation, efficiency, durability, good outlet temperature profiles, and compactness. Conventional gas turbine combustors can very easily be made to provide very low outputs of unburned fuel, and partially burned fuel in the form of carbon monoxide or unburned carbon. However, the usual gas turbine combustion apparatus operates at quite high temperature, and there is ordinarily a significant degree of combination of atmospheric nitrogen and oxygen to form undesired nitrogen oxides. Various expedients to reduce nitrogen oxides have been employed; but experience has shown that such expedients as reducing the residence time in the reaction area, reducing the maximum temperature in the reaction area, and early quenching of combustion tend to increase the output of incompletely burned fuel.

The problem of devising a low output combustion apparatus is complicated by the wide range of power levels over which an automotive engine must operate; that is, from idle to full power, and the need for relatively clean starting even with the engine cold. High temperature of the combustion air in a regenerative engine increases the tendency to form oxides of nitrogen.

The invention which is the subject of this patent application is one of a number of improvements to a gas turbine combustion chamber of a type generally known in the prior art. These refinements cooperate to bring emissions down to the prescribed level. The invention is described here in terms of its preferred embodiment, which includes others of these improvements.

The particular subject matter of this application is an improved combustion apparatus, with particular regard to a fuel vaporizing prechamber adapted to supply a lean mixture of vaporized fuel and air to the reaction zone of the apparatus, and to improved combustion air admission structure for a combustion liner, particularly involving air admission to the prechamber.

The principal objects of this invention are to provide an improved combustion apparatus suitable for automotive use, to provide a combustion chamber having a very clean exhaust, to provide an improved prevaporization arrangement for a combustor, and to improve structure for admission of combustion air to a combustion liner.

The nature of the invention and its advantages will be clear to those skilled in the art from the succeeding detailed description of the preferred embodiment and the accompanying drawings thereof.

Figure 1:
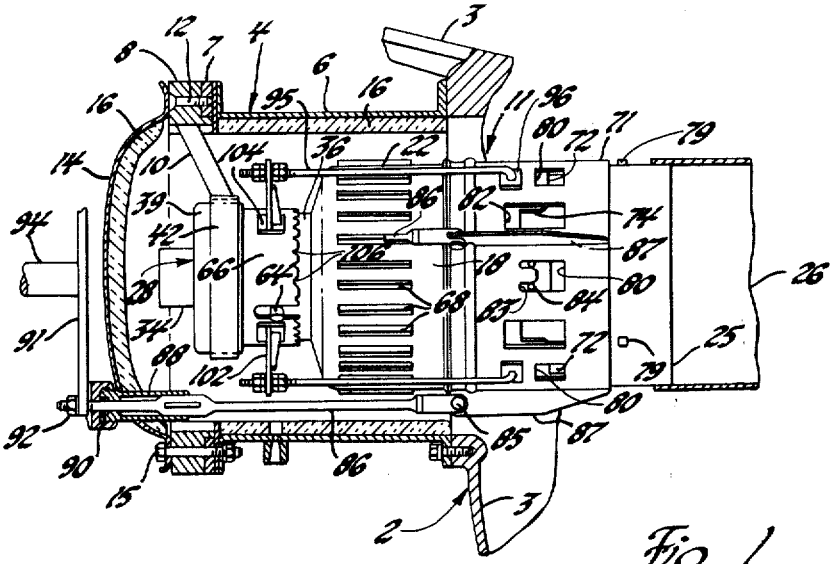
FIG. 1 is a longitudinal view of a combustion apparatus for a gas turbine engine, with parts cut away and in section.

Referring to FIG. 1, a gas turbine engine 2 includes an engine case 3. Further details of the engine are not shown or described, since they are immaterial to an understanding of the present invention. By way of background, however, the engine may be a regenerative gas turbine of the general nature of those described in U.S. Pats. to Collman et al., No. 3,077,074, Feb. 12, 1963; Collman et al., No. 3,267,674, Aug. 23, 1966; and Bell, No. 3,490,746, Jan. 20, 1970.

The engine case 3 forms part of an outer casing 4 of the combustion apparatus which also includes a cylindrical housing 6 bolted to the engine case. In an engine of this sort, the engine compressor (not illustrated) delivers compressed air which is heated in a regenerator (not illustrated) on its way into the combustion apparatus casing 4.

Figure 2:
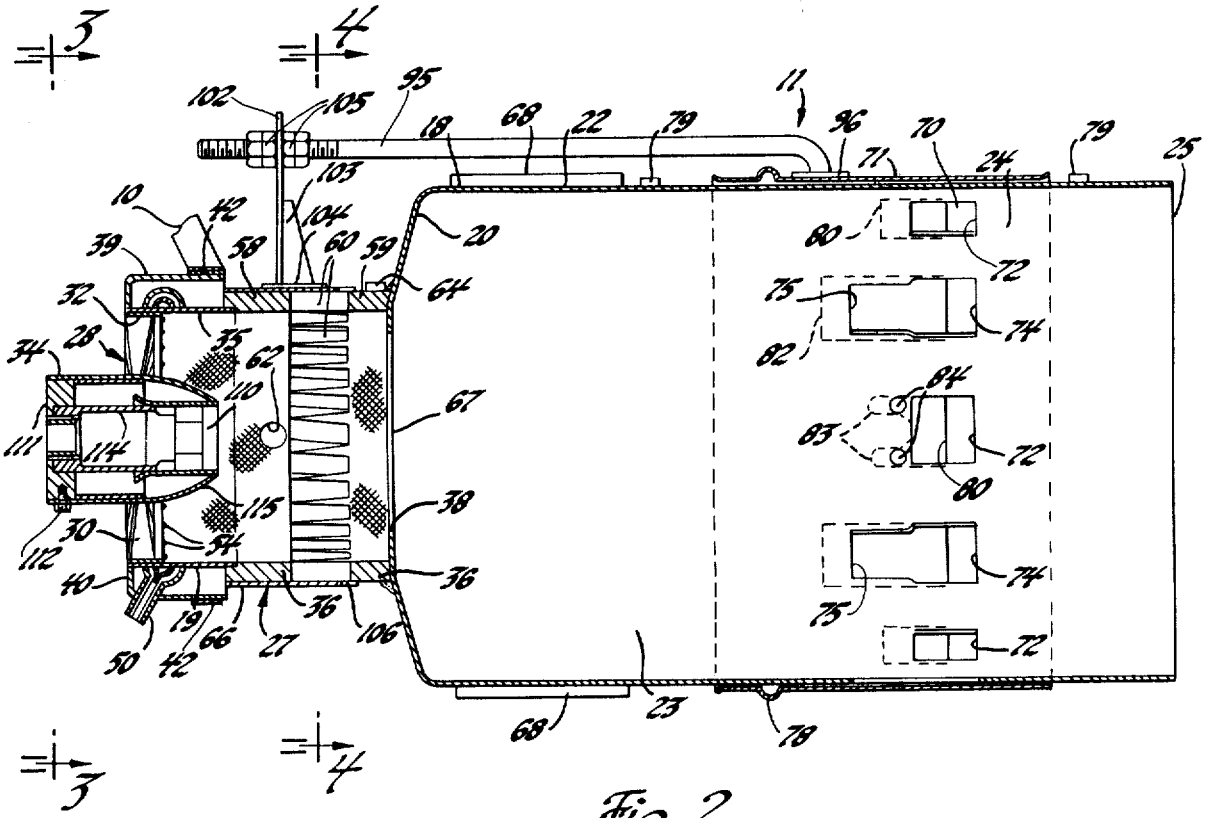
FIG. 2 is a longitudinal sectional view of the combustion liner.

Housing 6 terminates in a flange 7 to which is fixed a continuous outer ring 8 of a combustion liner support spider 10 which provides part of the support for a combustion liner 11 in which the invention is embodied. Ring 8 is fixed to flange 7 by circumferentially spaced countersunk screws 12. A combustion chamber cover 14 which overlies the ring 8 is fixed to the flange 7 by a ring of bolts 15 which extend through the ring and flange. The housing 6 and cover 14 are lined with thermal insulating material 16. Referring also to FIG. 2, the combustion liner 11 in its preferred form is of circular cross section and is bounded by walls 18. The liner wall includes a first prechamber or fuel vaporizing portion 19 which extends to an abrupt radial enlargement defined by a substantially radially outwardly extending wall portion 20 which is integral with and continues into a cylindrical wall portion 22. The wall portion 19 encloses a fuel vaporizing zone of the combustion apparatus and the wall 22 portion encloses a reaction zone 23 and a dilution zone 24. Wall 22 terminates in an outlet 25 for combustion products at the downstream end of the combustion liner. As shown in FIG. 1, the outlet end may be inserted into a combustion products duct 26 leading to the turbine (not shown). This supports the downstream end of the liner.

In operation of the combustion apparatus, fuel is evaporated and the fuel and air are mixed in a prechamber 27 enclosed by wall section 19. The fuel and air react, or combustion takes place, in the reaction zone 23 and additional air is introduced and mixed with combustion products in the dilution zone 24 to provide the ultimate mixture of combustion products to drive the turbine of the gas turbine engine.

Figure 3:
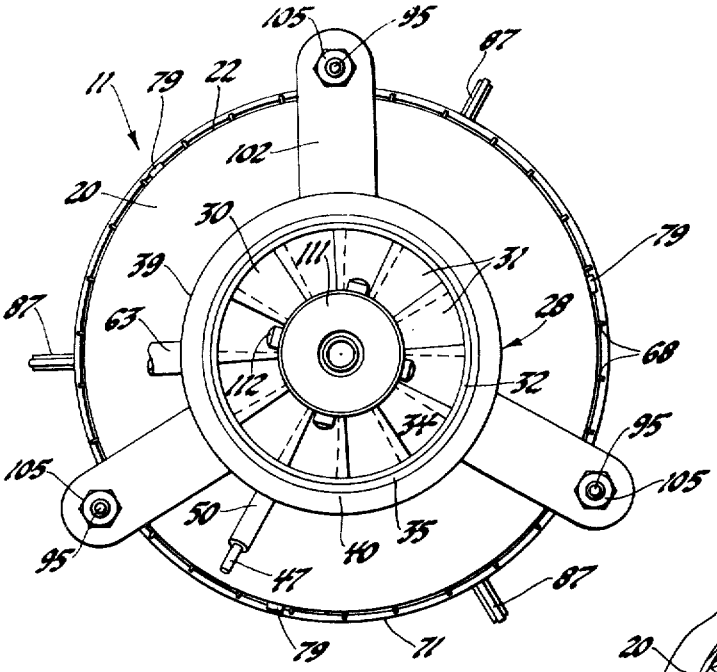
FIG. 3 is an upstream end view of the combustion liner taken on the plane indicated by the line 3—3 in FIG. 2.
Figure 5:
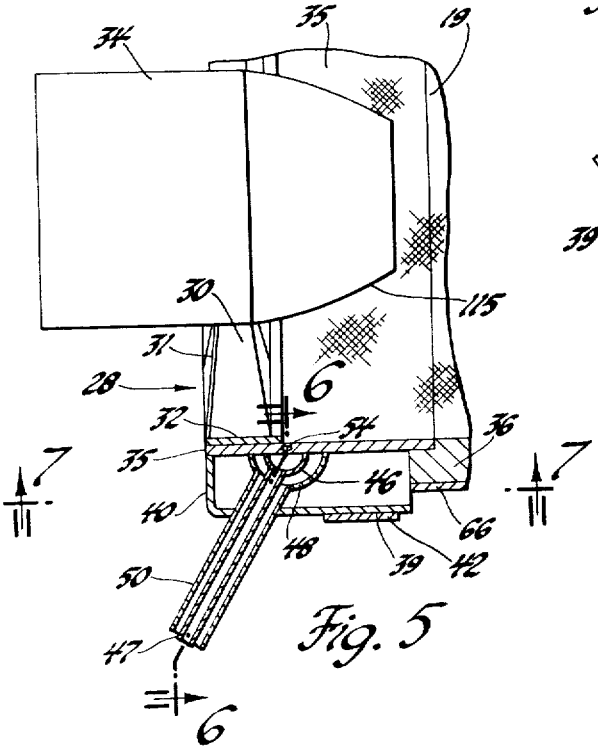
FIG. 5 is a fragmentary longitudinal sectional view of the prechamber.

Considering now in more detail the structure of the combustion liner, beginning with the upstream end 28, part of the combustion air enters the upstream end through a swirler 30 comprising an annular cascade of vanes 31 (see also FIGS. 3 and 5). These vanes extend from an outer ring 32 to a central sleeve 34, the latter extending forwardly from the swirler 30. The vanes of the swirler are set at an angle of 75° to a plane extending axially of the combustion apparatus so as to impart a strong swirl component to air entering the liner at this point from the outer casing 4. The outer ring 32 is welded or brazed to a prechamber forward wall portion 35. Wall section 35 is piloted within and fixed to the forward end of a rear prechamber wall portion 36. Wall portion 36 is of relatively heavy stock, about one-fourth to five-sixteenths inch in thickness. The downstream end of wall portion 36 is welded to the radially extending portion 20 of the main combustion chamber wall, these parts being concentric. Wall 20 extends radially inwardly from interior surface of wall portion 36 to provide a flow dam 28. The remainder of the combustion liner wall is cylindrical and integral with the portion 20. A sheet metal ring 39 extending over the forward portion of the prechamber has an inwardly extending flange 40 which is welded to the forward edge of wall portion 35. This ring 39 provides for connecting the forward end of the combustion liner to the support spider 10. The spider includes arms connecting outer ring 8 to an inner ring 42 (see also FIG. 1) which is suitably fixed or attached to the ring 39 of the liner.

The hot compressed air forced through swirler 30 will flow with a strong tangential component over the inner surface of wall portions 35 and 36 because of centrifugal force and will tend to scour these walls. In so doing, it vaporizes and picks up liquid hydrocarbon fuel which is fed to the inner surface of the prechamber just downstream of swirler 30. The fuel is introduced from a manifold 46 (see FIGS. 2, 5, 6, and 7) which is a ring of semicircular section extending entirely around the outer surface of wall portion 35. Fuel is delivered to this manifold through a fuel inlet tube 47 which extends into the combustion apparatus from a suitable fitting for connection to an external source of supply (not illustrated). Manifold 46 is enclosed within a cooling air jacket 48, likewise of semicircular cross section and likewise welded to the outer surface of wall section 35. Cooling air from a suitable source, for example from the compressor of the engine upstream of the regenerator, is supplied to the tube 48 through a cooling air pipe

Figure 6:
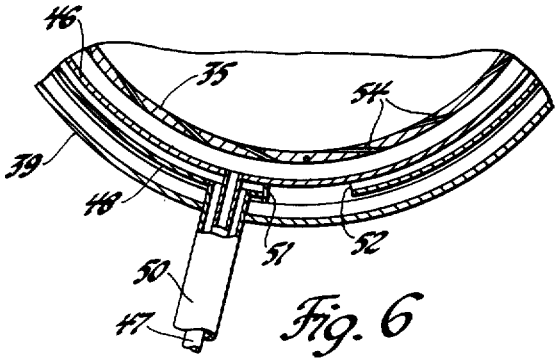
FIG. 6 is a detailed sectional view taken on the plane indicated by the line 6—6 in FIG. 5.
Figure 7:
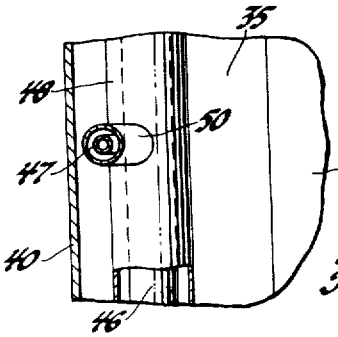
FIG. 7 is a fragmentary view taken on the plane indicated by the line 7—7 in FIG. 5.

50 which surrounds the fuel tube 47. The cooling air jacket extends almost entirely around the prechamber, as shown in FIG. 6. The gap in the circumference of the tube is closed adjacent the inlet pipe 50 by a semi-annular blocking plate 51 brazed or welded to tubes 46 and 48 and to the wall portion 35. Air introduced through tube 50 thus circulates over the fuel manifold to an outlet at 52 at the other end of the cooling air jacket. This circulation of air is to prevent boiling of the fuel under certain conditions of operation such as upon cutback of fuel with a hot engine, or during idling operation. It should be noted that the support ring 39 also shields the fuel manifold and the cooling air jacket to some extent from heat which may be radiated from hot engine components near the flame tube.

Fuel supplied to the manifold 46 through tube 47 is laid on the interior of the prechamber wall through 16 equally spaced fuel ports or orifices 54. These ports are 0.013 inch in diameter and make about a 15° angle with the outer surface of the wall so that the fuel is squirted onto the inner surface of the wall rather than into the air flowing through the swirler. The fuel is supplied at low pressure, the preferred maximum pressure drop through ports 54 being about 20 psi. The current of air flowing through the swirler blows the introduced fuel along the inner surface of the prechamber wall portions 35 and 36, and the hot rapidly moving air heats and vaporizes and mixes with the fuel before entry into the reaction zone 23.

Figure 8:
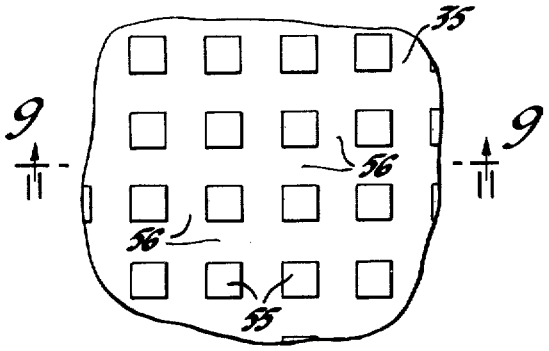
FIG. 8 is a fragmentary view of the interior of the prechamber illustrating a textured surface.
Figure 9:
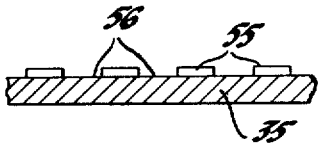
FIG. 9 is a cross-section of the same taken in the plane indicated by the line 9—9 in FIG. 8.

A substantial improvement in the vaporization and mixing of fuel with the air has been found to result from providing a roughened or textured surface on the interior of the prechamber wall. Preferably, this textured surface extends from just downstream of the fuel entrance ports 54 to the dam 38. This textured surface may be similar to a knurled surface. The preferred form may be more accurately described in connection with FIGS. 8 and 9. FIG. 8 is a view looking at the interior of the prechamber wall and FIG. 9 is a cross section of the same. The surface is relieved to provide a grid of two intersecting sets of small grooves 56 which leave between them small substantially rectangular bosses 55. This sort of textured surface may most readily be achieved by coating the areas which provide the bosses 55 with a suitable resist and then etching the surface to the desired depth. the resist may be applied by a photographic process, as is well understood. In the presently preferred form of the structure, the center to center spacing of adjacent grooves of each set is approximately 0.05 inch and the grooves are about 0.003 deep. The width of each groove is about the same as the width of the bosses between the grooves. Orientation of the grooves is preferably at about a 45° angle to the axial direction through the prechamber so that the fuel introduced into the inner wall may flow downstream of the prechamber under the influence of the air stream through the channels defined by the helically extending grooves 56.

It is believed that the superior performance with the textured surface is due to turbulence in the air flow on a small scale, aided by the bosses 55 which improve heat transfer from the air, and also to the partial shielding of the liquid fuel within the channels 56 from the direct blast of the air. At any rate, it has been demonstrated that this textured surface aids in the complete vaporization and diffusion of the fuel in the air.

It has been found that burning of a lean mixture in the reaction zone 23 is preferable from the standpoint of clean exhaust to burning of a nearer to stoichiometric mixture. It is found desirable to introduce some air beyond that introduced by the swirler 30 to further mix with and dilute the fuel-air mixture prior to the initiation of combustion. This effected by a set of air entrances distributed around the prechamber, preferably about three-fourths of its length from the upstream end to the downstream end. The presently preferred structure for introduction of additional air introduces the air with radially inward and tangential components of movement and no significant axial component. It also provides for variation of the effective area and therefore flow capacity of the prechamber downstream air inlet, which is desirable as a part of means for maintaining the desired equivalence ratio in the reaction zone. Equivalence ratio will be understood to mean the ratio of the actual weight ratio of fuel to air to the stoichiometric ratio of fuel to air. This is accomplished effectively by varying the ratio between the quantity of air flowing into the reaction zone from the prechamber to that introduced through dilution ports in the dilution zone 24 as the ratio of total airflow to fuel flow varies.

Figure 4:
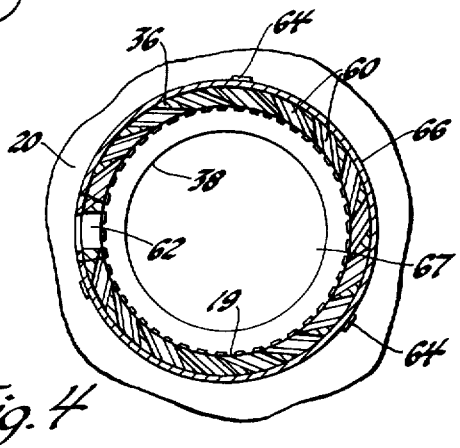
FIG. 4 is a cross sectional view of the prechamber taken on the plane indicated by the line 4—4 in FIG. 2.
Figure 10:
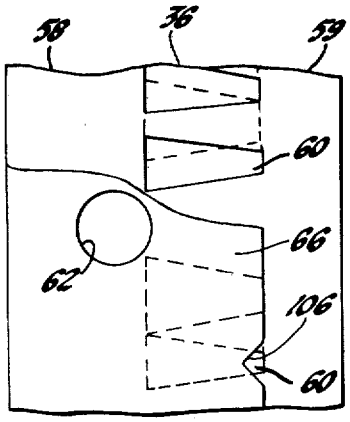
FIG. 10 is a fragmentary exterior view of the prechamber wall.

Considering first the air entrance means through the prechamber wall, ass illustrated in FIGS. 2, 4, and 10, the wall portion 36 is made in two coaxial abutting sections fixed together, an upstream section 58 and a downstream section 59. The air entrance means is defined by an annular array of slots 60 machined in the downstream edge of upstream section 58. Of course, they would be machined in the upstream portion of section 59 if the joint between the two sections is suitably located. It will be seen from FIGS. 4 and 10 that slots 60 enter the chamber at a considerable angle to the radial, about 60° in the particular case, and are so oriented that the direction of swirl of air from these slots is the same as that imparted by the inlet swirler 30. The outline of the slots is trapezoidal, the walls which bound the slots diverging from each other in the direction toward the upstream end of the prechamber. The fragmentary view of FIG. 10 shows two such slots. In the total circumference there are preferably eighteen air entrance slots.

The wall section 58 also defines a radial port 62 through which an igniter 63 (FIG. 3), which may be similar to a spark plug, extends into the prechamber so as to light off the fuel. The details of the igniter are immaterial, so it is not further described.

The exterior of section 59 may bear three bosses 64. These provide a limit to movement of a flow modulating sleeve 66 slidably mounted on the exterior of the prechamber wall portion 36. As will be further described, this sleeve provides means for varying the flow of air through slots 60.

Proceeding now to the reaction and dilution zones of the liner, these are enclosed within the wall 22 from the radially enlarging wall 20 downstream to the combustion products outlet 26. The walls of the combustion portion of the liner are imperforate. All the air for combustion is introduced through the prechamber outlet 67 defined by the inner margin of the flow dam 38. It has been found desirable, to improve cooling of the combustion section, to provide a circumferential array of fins 68 extending longitudinally of the wall 22 from the upstream end. These help in transfer of heat to the air flowing within the outer casing 4 toward the combustion air inlets.

The dilution zone 24 is characterized by an array 70 of dilution air entrance ports, the effective area of which is varied by a ported axially slidable flow modulating sleeve 71. As one means to attain the desired characteristics of change of dilution air flow area with movement of the sleeve 71, the ports 70 are of two sets alternating around the periphery of the liner. One set is of ports 72, which are rectangular and of the least dimension axially of the liner. Between these are the ports 74 of the second set which have an extension 75 toward the upstream end of the liner which is of smaller width circumferentially of the liner than the downstream portion of the ports 74.

The sleeve 71 is a simple cylinder with slightly flared ends and with a circumferential stiffening rib or ridge 78 near its upstream end. This sleeve is reciprocable on the outer surface of the liner, its travel being limited by two sets of small bosses 79 fixed to the outer surface of the liner, the bosses of each set being distributed 120° apart around the circumference of the liner.

The flow modulating sleeve 71 has two sets of ports each cooperating with one set of ports 72 or 74 of the liner wall. Rectangular ports 80 register with ports 72 of the wall and rectangular ports 82 register with ports 74. The length and width of the ports in the sleeve corresponds to the length and width of the corresponding port in the liner so that the liner ports can be fully opened at one setting of the sleeve. One of the short ports 80 has two slots 83 extending axially of the liner at its upstream edge. These slots provide clearance for two pins 84 which extend outwardly from the liner and are welded to the liner wall. These pins serve to locate the sleeve 71 circumferentially of the liner and obviate any tendency for the sleeve to rotate around the axis of the liner as it is moved back and forth to vary the dilution air flow.

The sleeve 71 is moved by three axially movable rods 86 (FIG. 1) which are coupled by pins 85 to webs 87 extending radially from the sleeve 71. Rods 86 extend through guides 88 in the combustion chamber cover 14 and through seals or glands 90 to a common actuator plate 91 to which the rods are fixed by nuts 92. The plate 91 may be coupled through a rod 94 to any suitable actuating mechanism capable of sliding the sleeve 71 axially of the liner.

The flow modulating sleeve 66 which varies the flow area through the ports 60 of the prechamber is rigidly coupled to sleeve 71 for concurrent movement by the input device 94. This interconnection includes three rods 95 extending axially of and distributed around the circumference of the liner. Each rod is fixed at an anchorage 96 to the sleeve 71. They are adjustably connected to sleeve 66. This connection is effected through arms 102 fixed to the sleeve 66 120° apart and extending radially outwardly. The arms are stiffened by gussets 103 welded to the arms and through a base plate 104 to the sleeve 66.

The forward end of each rod 95 is threaded and extends through a hole at the extremity of an arm 102. The connection is completed by two sets of double nuts 105 which may be adjusted to trim the relative positions of the two flow controlling sleeves. It will be seen that the two sets of sleeves move so that, as the ports 60 in the prechamber open, the ports 70 in the dilution area close.

Clearly, many operating connections to the sleeves 66 and 71 may be devised. That shown is simple and meets the requirements.

The downstream edge of sleeve 66 is notched as indicated at 106 in FIGS. 1 and 2. There is a notch aligned with each air entrance slot 60, the notches being V-shaped and having an included angle of about 70°. These notches are slightly wider than the downstream end of slots 60. They provide a tapering rather than an abrupt opening or closing of the slots 60 as the sleeve 66 moves so that its rear edge passes the rear edge of the slots.

Figure 11:
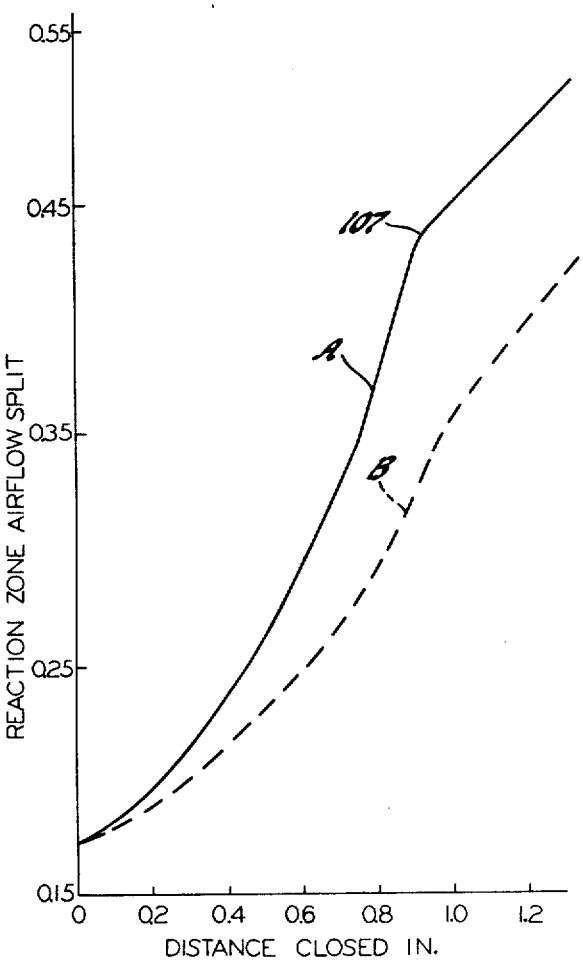
FIG. 11 is a plot of airflow distribution.

The particular configuration of the air entrance openings 60, 72, and 74 is such as to provide a desirable characteristic of variation of the relative amounts of primary and dilution air as the input rod 94 is reciprocated. FIG. 11 illustrates the variation of air flow with movement of the flow controlling sleeves. Specifically, curve A of FIG. 11 shows the proportion of air entering the reaction zone through the swirler 30 and the slots 60 to the total air admitted, which is this amount of air plus that entering through the dilution ports at 70. It will be noted that the reaction zone air flow increases from about 17 percent with the sleeves at their maximum downstream position to approximately 55 percent with the sleeves moved forwardly to provide maximum reaction air flow relative to dilution air flow. Put another way, the dilution air flow decreases from about 83 percent to about 45 percent of total flow over this range of movement of the sleeves. This makes it possible to provide adequate air flow in the reaction zone under high power conditions without having the reaction zone undesirably rich as the power level of the engine is decreased. At small fuel flows, as under engine idling conditions, a relatively small part of the air is required to provide the desired equivalence ratio of about 0.3 in the reaction zone. The bend at 107 in curve A represents closing of the short dilution ports 72.

A pilot fuel nozzle 110 is mounted in the prechamber. This nozzle is preferably of an air-atomizing type supplied with compressed air and fuel through tubes (not illustrated) which enter through a supporting structure including a ring 111 fixed within the sleeve 34 by cap screws 112. This arrangement provides a suitable support for the fuel nozzle which includes a tubular extension 114 threadably coupled with the ring 111. The details of the fuel nozzle are not material to the present invention. With this type of fuel nozzle, the fuel is sprayed in fine droplets by an air blast. The pilot fuel nozzle is provided for starting combustion, particularly when the engine is cold and therefore evaporation of fuel from the prechamber wall is not effective. The pilot nozzle is turned off after normal operation has begun. Other starting expedients such as use of gaseous fuel may be employed, but are not considered as feasible as the use of the pilot nozzle.

A converging fairing 115 extends from the downstream end of sleeve 34 to the downstream end of the fuel nozzle 110 to provide a smooth transition of flow from the swirler 30 into the prechamber.

In starting the engine, air flow is low and conditions are abnormal. In this case the flow modulating sleeve moves forward so as to diminish dilution air and direct the major part of the air into the prechamber where it mixes with the fuel from the pilot nozzle and burns when the igniter is energized. When the engine reaches normal operating conditions, the starting regime is terminated and the position of the flow modulating sleeves is varied as necessary to attain the desired equivalence ratio at the entrance to the reaction zone.

In operation of a regenerative engine at full power, the air enters the combustion apparatus at about 1,100°F. and after passing through the swirler 30 flows over the inside of the prechamber wall, heating, evaporating, and mixing with the fuel introduced from the manifold 46 through the orifices 54. This mixture of air and vaporized fuel is further mixed with additional combustion air which enters through the swirl ports 60 with swirl in the same direction as the air flowing rearwardly through the prechamber. These two flows then mix to provide a rather lean fuel-air mixture, preferably with about three times the amount of air required for combustion; that is, three times the stoichiometric amount of air.

The swirling fuel-air mixture spills over the dam 38 and because of the swirl flows tangentially and radially outward to the outer wall 22 of the liner and then, because of the creation of a low pressure area along the axis of the combustion zone and prechamber, it flows in a more or less toroidal vortex with some upstream or recirculating flow along the axis of the liner. This flow may penetrate into the downstream part of the prechamber under some conditions of operation and in this case may also tend to heat the prechamber.

The dilution air admitted through the openings at 70 tends to quench the heat of the combustion mixture which flows along the wall 22 toward the outlet 25. In addition, the radially entering streams of air as they meet toward the axis tend to project some of the dilution air forwardly into the low pressure zone on the combustion chamber axis where this mixes with the recirculating combustion products to assist in cooling the combustion products at any early time, reducing duration of high temperature in the gas.

The lean combustion lowers the combustion temperature and the prompt quenching of the gas lowers the residence time at high temperature. Both of these effects serve to minimize formation of nitrogen oxide.

Also, the burning of the fuel in a vaporized condition reduces conditions of local richness which will be found in the vicinity of atomized droplets of fuel and which tend to increase generation of nitrogen oxide.

While there seems to be no need to recite details of dimensions which are variable to suit any particular installation, it may be mentioned that the combustion line shown, which is for a 225 horsepower gas turbine engine, is 6⅝ inches in diameter and 15 inches long, and is shown in true proportion in FIG. 2.

It is possible, of course, to vary the ratio of primary to dilution air by throttling one set of ports only. The broken line curve B in FIG. 11 illustrates the relation of reaction zone air flow to total flow in an apparatus of the sort illustrated in which the change of flow is due only to the movement of the sleeve 71, the downstream air entrance of the prechamber being of fixed area. For a given structure, the variation is less and the pressure drop is greater if modulation is effected at only one set of ports. Since pressure drops are inimical to engine efficiency, there is good reason to modulate both sets of air ports.

Figure 12:
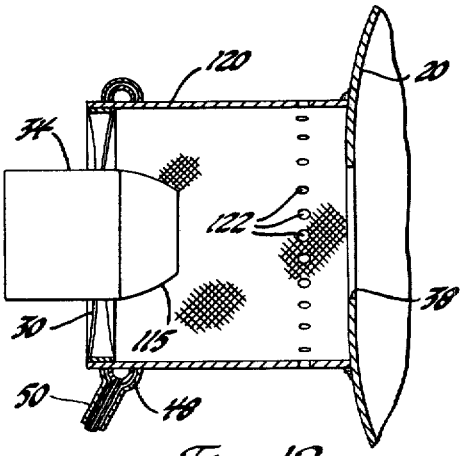
FIG. 12 is a partial elevation view illustrating an alternative prechamber arrangement.

FIG. 12 illustrates a variation of the combustion liner which may be in most respects essentially as shown in figures previously discussed. The liner of FIG. 12 differs from that of FIG. 2 in the mode of introduction of air into the prechamber, and the portion of the combustion liner downstream of that illustrated in FIG. 12 may be as illustrated in FIG. 2. As illustrated in FIG. 12, the prechamber wall 120 is a sheet metal structure of constant thickness bearing the swirler 30 at its forward end and with the central plug 34, 115 at the center of the swirler to support the starting fuel nozzle. The interior of the prechamber wall is preferably textured as previously described.

The arrangement for introduction of additional primary air toward the downstream end of the prechamber in this case is a ring of circular holes 122 spaced uniformly around the prechamber. In one instance, the holes are ⅛ inch diameter and there are 36 holes. In this case, a slightly smaller percentage of the air was admitted through the holes 122 than through the ports 60 of FIG. 2. However, in this case, the swirler 30 was slightly more open, having the blades set at a 70° angle to the axial direction rather than 75°. No variation of the ports 122 was provided. While this apparatus does not perform as cleanly as that described above, it is a relatively clean combustion apparatus that might well serve quite satisfactorily in various applications.

We believe that the foregoing description of preferred structure will be sufficient for an understanding of the invention and its preferred embodiment by those skilled in the art. As will be appreciated, details of structure, dimensions, and the like may be varied in response to the conditions of particular installations.

The admission of all combustion air through the prechamber, as distinguished from dividing the admission between the prechamber and the reaction zone, is highly favorable to good combustion in a lean fuel-air mixture and thus to minimizing undesired emissions from the combustion apparatus.

The detailed description of the preferred embodiment of the invention for the purpose of explaining the principles thereof is not to be considered as limiting or restricting the invention, since many modifications may be made by the exercise of skill in the art.

I claim:

1. A combustion apparatus adapted for use in a gas turbine engine characterized by substantially complete combustion of liquid hydrocarbon fuel and by a low output of nitrogen oxides, the apparatus comprising a combustion liner having a discharge outlet for combustion products at the downstream end of the liner; the liner having an upstream end and liner wall means extending from the upstream end to the downstream end, the wall means enclosing, in sequence from the upstream end to the downstream end, a prechamber for providing a homogeneous mixture of vaporized fuel and air, a reaction zone for combustion of the fuel flowing from the prechamber in the air flowing from the prechamber, and a dilution zone for mixing the combustion products from the reaction zone with additional air; the prechamber being of significantly smaller cross-sectional area than the reaction zone and being joined to the reaction zone by an abruptly diverging wall portion; the prechamber including first air entrance means defined by swirler means at its upstream end effective to direct combustion air with a substantial circumferential velocity component downstream over the inner surface of the prechamber wall means so as to scour the wall means, liquid fuel introduction means downstream of the swirler means disposed to lay a film of liquid fuel on the said inner surface for evaporation by and mixture with the said combustion air, and second air entrance means defined by a circumferential ring of ports through the prechamber wall near the downstream end of the prechamber adapted to introduce air flowing radially inward to mix with and dilute the fuel-air mixture prior to combustion; the reaction zone having an imperforate wall and providing turbulent recirculating flow of burning fuel-air mixture and combustion products resulting from the swirl of the entering mixture and the abrupt divergence of the wall means; and the dilution zone including dilution air entrance means located so as to admit air for mixture with recirculating gas in the reaction zone and for dilution of the combustion products flowing from the reaction zone to the discharge outlet.

2. A combustion apparatus adapted for use in a gas turbine engine characterized by substantially complete combustion of liquid hydrocarbon fuel and by a low output of nitrogen oxides, the apparatus comprising a combustion liner having a discharge outlet for combustion products at the downstream end of the liner; the liner having an upstream end and liner wall means extending from the upstream end to the downstream end, the wall means enclosing, in sequence from the upstream end to the downstream end, a prechamber for providing a homogeneous mixture of vaporized fuel and air, a reaction zone for combustion of the fuel flowing from the prechamber in the air flowing from the prechamber, and a dilution zone for mixing the combustion products from the reaction zone with additional air; the prechamber being of approximately one-quarter the cross-sectional area of the reaction zone and being joined to the reaction zone by an abruptly diverging wall portion; the prechamber including first air entrance means defined by swirler means at its upstream end effective to direct combustion air with a substantial circumferential velocity component downstream over the inner surface of the prechamber wall means so as to scour the wall means, liquid fuel introduction means downstream of the swirler means disposed to lay a film of liquid fuel on the said inner surface for evaporation by and mixture with the said combustion air, and second air entrance means defined by a circumferential ring of ports through the prechamber wall near the downstream end of the prechamber adapted to introduce air flowing radially inward to mix with and dilute the fuel-air mixture prior to combustion; the reaction zone having an imperforate wall and providing turbulent recirculating flow of burning fuel-air mixture and combustion products resulting from the swirl of the entering mixture and the abrupt divergence of the wall means; the dilution zone including dilution air entrance means located so as to admit air for mixture with recirculating gas in the reaction zone and for dilution of the combustion products flowing from the reaction zone to the discharge outlet; and the relation of the entrance means being such as to provide an equivalence ratio of about 0.25 to 0.5 in the fuel-air mixture flowing from the prechamber into the reaction zone.

* * * * *